United States Patent [19]

Heilskov

[11] Patent Number: 4,475,628

[45] Date of Patent: Oct. 9, 1984

[54] LANDING NET

[76] Inventor: Jens A. Heilskov, Post Office Drawer 5007, Wilmington, N.C. 28403

[21] Appl. No.: 489,565

[22] Filed: Apr. 28, 1983

[51] Int. Cl.[3] ..... E06C 1/56; E06C 9/14

[52] U.S. Cl. ..... 182/198; 182/138

[58] Field of Search ..... 182/196, 197, 198, 100, 182/137, 138, 139

[56] References Cited

U.S. PATENT DOCUMENTS

| | | | |
|---|---|---|---|
| 263,560 | 8/1882 | Miller | 182/196 |
| 376,034 | 1/1888 | Hughes | 182/197 |
| 2,286,936 | 6/1942 | Scrutton | 182/196 |
| 2,343,123 | 2/1944 | Dahlander | 182/198 |
| 2,385,824 | 10/1945 | Margolin | 182/197 |
| 2,397,972 | 4/1946 | Mosher | 182/197 |
| 2,816,263 | 12/1957 | Stertz | 323/251 |
| 3,091,016 | 5/1963 | Pedley | 244/50 |
| 3,091,834 | 6/1963 | Pedley | 28/393 |
| 3,422,925 | 1/1969 | Petrie | 182/196 |
| 3,527,319 | 9/1970 | Pedley | 182/139 |

FOREIGN PATENT DOCUMENTS

| | | | |
|---|---|---|---|
| 1067701 | 10/1959 | Fed. Rep. of Germany | 182/197 |

*Primary Examiner*—R. P. Machado

*Attorney, Agent, or Firm*—Wood, Dalton, Phillips Mason & Rowe

[57] ABSTRACT

A net for use as an embarkation-debarkation net having spacer blocks provided integrally therewith for maintaining the plane of the net configuration spaced forwardly of a rear portion of the respective distributed spacer blocks. Securing elements are provided at less than all of the crossing positions of the longitudinal and transverse lines of the net. An improved spreader structure is provided utilizing a tubular cross member and short tubular vertical members for receiving the longitudinal lines of the net. The spacer blocks provide a self-fending action when the net is used as an embarkation-debarkation net, and provide cushioning of cargo where the net is used as a cargo net.

20 Claims, 4 Drawing Figures

LANDING NET

TECHNICAL FIELD

This invention relates to nets and in particular to landing nets, such as used for embarking and debarking personnel relative to marine craft.

BACKGROUND ART

It has been conventional in applications such as military uses, for embarking and debarking personnel by nets hung over the side of the marine craft so as to effectively define a plurality of side-by-side ladders.

A serious problem arises in the use of the prior art nets in that the nets tend to fly directly against the surface of the craft, making it, at times, difficult for the personnel to safely grasp the lines of the net in moving thereover.

It is further necessary to effectively maintain the spaced relationships of the lines making up the net against the relatively substantial forces involved in the personnel using the nets. One tie conventionally used for securing the crossed lines to each other is illustrated in U.S. Pat. Nos. 2,816,263, 3,091,834, 3,527,319 and 3,091,016, owned by Pedley-Knowles and Company. As disclosed, the sides are formed of fiberglass-reinforced polyester resin.

DISCLOSURE OF INVENTION

The present invention comprehends an improved embarkation-debarkation net having means for spacing the net outwardly from a wall to which the net is juxtaposed.

More specifically, in the illustrated embodiment, the net is provided with a plurality of spacer blocks disposed at line crossings to space the net outwardly from a rear portion thereof.

In the illustrated embodiment, the spacer blocks define crossing through bores receiving longitudinal and transverse lines at the line crossings.

In the illustrated embodiment, the invention comprehends line-retaining means at opposite ends of the spacer block bores for retaining the spacer blocks against displacement from the line crossing position in the bores.

In the illustrated embodiment, the spacer blocks are spherical and formed of a resilient material, such as rubber or synthetic resin.

The spacer blocks preferably have a dimension rearwardly of the flatwise extent of the net grid configuration substantially greater than the diameter of the lines.

In one embodiment, the line-retaining means includes an annular line retainer and a disc element between the line retainer and the spacer block.

In the illustrated embodiment, the spacer blocks define nonintersecting perpendicularly crossing through bores receiving the crossing lines.

The invention comprehends the provision of new and improved spreader bars, including a tubular element extending across the net and a plurality of short tubular members fixedly secured to the tubular elements at spaced intervals corresponding to the desired transverse spacing between the longitudinal lines of the net.

In the illustrated embodiment, the longitudinal lines extend one each through the tubular members affixed to the spreader bar tubular element, and the tubular members are constricted about the longitudinal lines to secure them in place.

The embarkation-debarkation net of the present invention is extremely simple and economical of construction while providing the highly desirable features discussed above.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
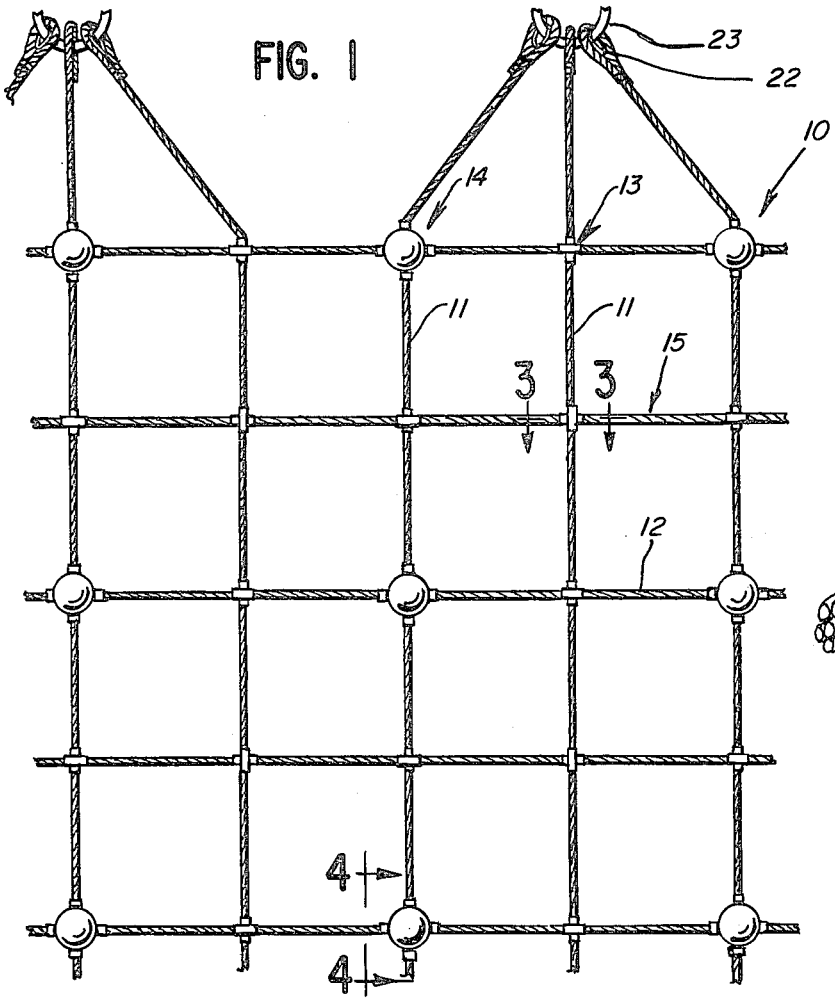
FIG. 1 is a fragmentary vertical elevation of a net embodying the invention.

In the exemplary embodiment of the invention as disclosed in the drawing, an embarkation-debarkation net generally designated 10 is shown to comprise a plurality of longitudinal lines 11 and transverse lines 12 crossing at spaced positions to define a preselected open net grid configuration, as best seen in FIG. 1.

A plurality of securing elements generally designated 13 is provided for securing the crossed lines at less than all of the crossings thereof to retain the lines in the preselected grid configuration.

As indicated briefly above, the present invention is concerned with the problem of maintaining a spacing of the grid configuration from a vertical wall, or the like, to which the net is juxtaposed in use. Thus, illustratively, where the net is used as an embarkation-debarkation marine net, the invention comprehends means for spacing the net outwardly from the sidewall of the marine craft so as to permit facilitated use of the net by personnel embarking or debarking by means of the net. In the illustrated embodiment, the net spacing means is defined by a plurality of spacer blocks generally designated 14.

It is further desirable in such nets to provide means for maintaining the lateral spacing between the vertical or longitudinally extending lines 11. In the illustrated embodiment, such means are provided in the form of spreader means generally designated 15.

Figure 4:
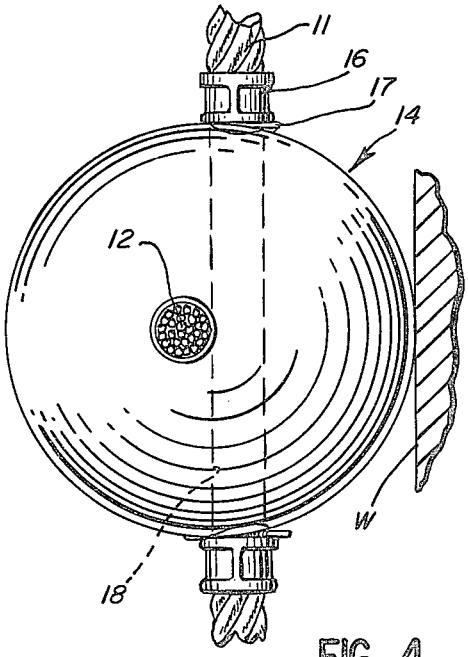
FIG. 4 is a fragmentary enlarged section taken substantially along the line 4—4 of FIG. 1.

The spacer block 14, as best seen in FIG. 4, comprises, in the illustrated embodiment, a spherical block formed of a suitable material for supporting the net away from the juxtaposed wall surface W. Illustratively, the spacer blocks may be formed of a resilient material, such as rubber. In one form, the spacer blocks are formed of a synthetic resin, such as polyurethane or the like.

Preferably, the spacer blocks are formed of a nonscuffing material so as to minimize abrasion or deformation of the wall surface W in use.

The blocks preferably have a rearward extent from the flatwise extent of the net grid configuration substantially greater than the diameter of the lines. Thus, as seen in FIG. 4, the thickness, or diameter, of the spacer block transversely to the flatwise extent of the net grid configuration is at least four times the diameter of the lines 11 and 12. More specifically, as shown in FIG. 4, the diameter of the spacer block is approximately nine times that of the lines. Thus, as shown in FIG. 4, the spherical spacer blocks may have a diameter in the range of less than approximately 6 inches to more than 10 inches.

In the illustrated embodiment, the crossing lines may be secured positionally relative to the spacer blocks by annular line retainers 16 and cooperating washers 17 having a diameter substantially greater than the diameter of the bores 18 in the spacer block through which the lines 11 and 12 extend. As shown in FIG. 4, the line retainers may be crimped onto the lines at opposite ends of the bores 18 to secure the lines in crossing relationship.

In the illustrated embodiment, the bores 18 through which the vertical longitudinal lines 11 and transverse horizontal lines 12 extend are nonintersecting, perpendicularly crossing, it being understood that other configurations for the bores may be utilized within the scope of the invention, as desired.

Figure 2:
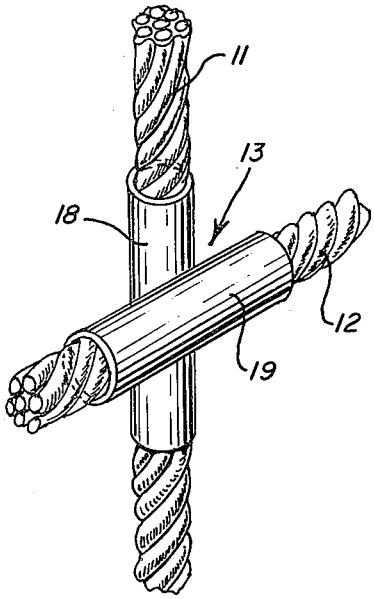
FIG. 2 is a fragmentary enlarged perspective view of the securing elements thereof.

Referring now to FIG. 2, the securing elements 13, in the illustrated embodiment, comprise perpendicularly crossed pairs of tubular elements 18 and 19 through which the lines 11 and 12 extend in crossing relationship. Where the tubular elements are made of metal, they may be hydraulically compressed so as to be locked to the lines at the crossing positions. Other materials may be utilized within the scope of the invention. Illustratively, plastic tubular elements may be utilized formed of heat-shrinkable material secured to the lines by application of suitable heat thereto.

Figure 3:
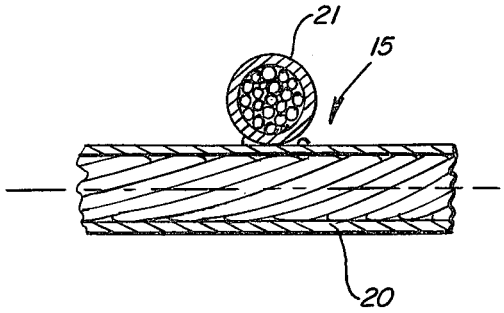
FIG. 3 is a fragmentary enlarged section taken substantially along the line 3—3 of FIG. 1.

The spreader means 15 is illustrated in greater detail in FIG. 3 to comprise an elongated tubular element 20 extending across the net, and a plurality of short tubular members 21 secured at preselected spaced intervals to the tubular element 20 corresponding to the desired transverse spacing between the longitudinal lines 11, as seen in FIG. 1. The longitudinal lines extend one each through the tubular members 21, which may be secured to the lines as by constriction, heat-shrinking, etc.

INDUSTRIAL APPLICABILITY

Thus, the improved net structure 10 provides a self-fending functioning providing facilitated use in embarkation and debarkation of personnel as relative to marine craft and the like.

The invention is further advantageously adapted for use as a cargo net, with the resilient spacer blocks acting as cushions for cushioning cargo and the like carried by the net when placed on a dock or in the hold of a marine craft.

Where the net is to be used in embarkation-debarkation procedures, one end of each of the longitudinal or vertical lines may be provided with suitable thimbles 22, as for use in securing lashings 23, and the like, thereto and to supports carried on the craft. As will be obvious to those skilled in the art, other means for securing the edge portions of the net as desired may be utilized within the scope of the invention.

The spacing of the lines in the net may be varied as desired, and thus, illustratively, the nets may vary from 6-inch spacings or less to 12-inch or greater spacings. In the illustrated embodiment, the net configuration is generally square. As will be obvious to those skilled in the art, any other desired arrangement, either regular or irregular as desired, may be utilized. Similarly, different size ropes and ropes formed of a wide range of different materials may be utilized in the net configuration, as desired.

An excellent rubbery material for use as the spacer block is an aliphatic poly-ether urethane synthetic resin, which has been found to have excellent resistance to weathering and, thus, is advantageously adapted for outdoor applications.

The foregoing disclosure of specific embodiments is illustrative of the broad inventive concepts comprehended by the invention.

I claim:

1. In an embarkation-debarkation net having a plurality of longitudinal and transverse lines crossing at spaced positions to define a preselected open net grid configuration, and a plurality of securing elements securing the crossed lines at less than all of the crossings to retain the lines in said preselected grid configuration, the improvement comprising:

a plurality of spacer blocks disposed at line crossings to space the net outwardly from a rear portion thereof, said spacer blocks defining crossing through bores, one of said bores receiving a longitudinal line and the other of said bores receiving a transverse line at the line crossing; and line-retaining means for retaining the spacer blocks against displacement from the line crossing position in said bores.

2. The embarkation-debarkation net structure of claim 1 wherein said spacer blocks are spherical.

3. The embarkation-debarkation net structure of claim 1 wherein said spacer blocks are formed of a resilient material.

4. The embarkation-debarkation net structure of claim 1 wherein said spacer blocks are formed of rubber.

5. The embarkation-debarkation net structure of claim 1 wherein said spacer blocks are formed of synthetic resin.

6. The embarkation-debarkation net structure of claim 1 wherein said spacer blocks are formed of polyurethane.

7. The embarkation-debarkation net structure of claim 1 wherein said spacer blocks have a thickness transversely to the flatwise extent of the net grid configuration at least four times the diameter of said lines.

8. The embarkation-debarkation net structure of claim 1 wherein said spacer blocks have a thickness transversely to the flatwise extent of the net grid configuration approximately nine times the diameter of said lines.

9. The embarkation-debarkation net structure of claim 1 wherein said spacer block is spherical and has a diameter in the range of approximately 6 inches to 10 inches.

10. The embarkation-debarkation net structure of claim 1 wherein each said line-retaining means includes annular line retainers secured to the lines and a disc element having an outer diameter substantially greater than the diameter of the bore between the line retainer and spacer block.

11. In an embarkation-debarkation net having a plurality of longitudinal and transverse lines crossing at spaced positions to define a preselected open net grid configuration, and a plurality of securing elements securing the crossed lines at less than all of the crossings to retain the lines in said preselected grid configuration, the improvement comprising:

a plurality of resilient spacer blocks disposed one each at line crossings to space the net outwardly from a rear portion thereof, each of said spacer blocks defining nonintersecting crossing through bores, one of said bores receiving a longitudinal line and the other of said bores receiving a transverse line at the line crossing; and a plurality of rigid line retainers secured to the crossing lines at opposite ends of the spacer block bores for retaining the spacer blocks against displacement from the line crossing position in said bores.

12. The embarkation-debarkation net structure of claim 11 wherein each said line retainer comprises an annular element constricted about the line and a large outer diameter disc element between said spacer block and said annular element abutting the spacer block about the end of the bore.

13. The embarkation-debarkation net structure of claim 11 wherein said securing elements comprise a perpendicularly crossed pair of tubular elements receiving one each the crossed lines, said securing elements being constricted about the bores.

14. The embarkation-debarkation net structure of claim 11 wherein said securing elements comprise a perpendicularly crossed pair of tubular elements receiving one each the crossed lines, said securing elements being formed of metal and being crimped about the bores.

15. The embarkation-debarkation net structure of claim 11 wherein said securing elements comprise a perpendicularly crossed pair of tubular elements receiving one each the crossed lines, said securing elements being formed of heat-shrinkable synthetic resin and being heat shrunk about the bores.

16. In an embarkation-debarkation net having a plurality of longitudinal and transverse lines crossing at spaced positions to define a preselected open net grid configuration, and a plurality of securing elements securing the crossed lines at less than all of the crossings to retain the lines in said preselected grid configuration, improved spreader means comprising:

a tubular element extending across the net; and a plurality of short tubular members fixedly secured to said tubular element at spaced intervals corresponding to the desired transverse spacing between the longitudinal lines of the net, said longitudinal lines extending one each through said tubular members, said tubular members being constricted about the longitudinal lines.

17. The embarkation-debarkation net structure of claim 16 wherein said tubular element comprises a metal tube.

18. The embarkation-debarkation net structure of claim 16 wherein said tubular members extend diametrically through said tubular element.

19. The embarkataion-debarkation net structure of claim 16 further including a plurality of spacer blocks disposed one each at line crossings free of said securing elements, each of said spacer blocks defining nonintersecting perpendicularly crossing through bores, one of said bores receiving a longitudinal line and the other of said bores receiving a transverse line at the line crossing, and a plurality of annular line retainers secured to the crossing lines at opposite ends of the spacer block bores for retaining the spacer blocks against displacement from the line crossing position in said bores.

20. The embarkation-debarkation net structure of claim 16 further including a plurality of spacer blocks disposed one each at line crossings free of said securing elements to space the net outwardly from a rear portion thereof, each of said spacer blocks defining nonintersecting perpendicularly crossing through bores, one of said bores receiving a longitudinal line and the other of said bores receiving a transverse line at the line crossing, and a plurality of annular line retainers secured to the crossing lines at opposite ends of the spacer block bores for retaining the spacer blocks against displacement from the line crossing position in said bores, each said securing element comprising a pair of tubular elements receiving one each the crossed lines, said securing elements being constricted about the bores.

* * * * *